US005267824A

United States Patent [19]

Kishi

[11] Patent Number: 5,267,824

[45] Date of Patent: Dec. 7, 1993

[54] TOOL CONTROLLING MECHANISMS FOR EXCAVATOR WITH TELESCOPIC ARM

[75] Inventor: Mitsuhiro Kishi, Tochigi, Japan

[73] Assignee: Kabushiki Kaisha Japanic, Tochigi, Japan

[21] Appl. No.: 742,756

[22] Filed: Aug. 8, 1991

Related U.S. Application Data

[63] Continuation-in-part of Ser. No. 506,690, Apr. 9, 1990, Pat. No. 5,092,733.

[30] Foreign Application Priority Data

Aug. 10, 1990 [JP] Japan ..... 2-212366

[51] Int. Cl.[5] ..... B66C 23/00

[52] U.S. Cl. ..... 414/718; 414/912; 414/694; 52/118; 212/268

[58] Field of Search ..... 414/718, 728, 547, 912, 414/685, 680, 695.5, 687, 694; 212/267, 268, 269; 52/118

[56] References Cited

U.S. PATENT DOCUMENTS

| | | | |
|---|---|---|---|
| 3,245,559 | 4/1966 | Russell | 414/718 X |
| 3,390,794 | 7/1968 | McMullen et al. | 414/718 X |
| 3,624,785 | 11/1971 | Wilson | 414/718 X |
| 3,688,930 | 9/1972 | Shumaker | 414/718 |
| 3,836,025 | 9/1974 | Olson et al. | 414/547 |
| 3,874,532 | 1/1975 | Metailler | 414/912 X |
| 4,274,797 | 6/1981 | Coon | 414/718 X |
| 4,293,270 | 10/1981 | Prime | 414/718 |
| 4,523,684 | 6/1985 | Baisden | 414/912 X |
| 4,699,562 | 10/1987 | Crook et al. | 414/718 X |
| 4,793,765 | 12/1988 | Paul et al. | 414/718 |

FOREIGN PATENT DOCUMENTS 2-161024 6/1990 Japan .

*Primary Examiner*—Michael S. Huppert
*Assistant Examiner*—James T. Eller, Jr.
*Attorney, Agent, or Firm*—Flynn, Thiel, Boutell & Tanis

[57] ABSTRACT

An excavator comprising a movable body, a boom mounted on the movable body, first hydraulic cylinders, an outer arm pivotally mounted on the boom, a second hydraulic cylinder mounted on a rear surface of the boom, an inner arm inserted into the outer arm and movable telescopically relative to the outer arm, a bucket connected to one end of the inner arm, a bucket connected to the tip end of the inner arm, a bucket cylinder provided between the bucket and a guide mechanism, the guide mechanism being slidably mounted on guide plates fixed to the outer arm, a third hydraulic cylinder connected to a base end of the outer arm and having a rod connected to a central portion of the inner arm for moving the inner arm relative to the outer arm, and an interlocking device connected between the guide mechanism and the front portion of the inner arm. A hook mechanism can be mounted at a front portion of the inner arm.

9 Claims, 19 Drawing Sheets

TOOL CONTROLLING MECHANISMS FOR EXCAVATOR WITH TELESCOPIC ARM

CROSS-REFERENCE TO RELATED APPLICATIONS

This application is a continuation-in-part of U.S. Ser. No. 07/506,690, filed Apr. 9, 1990, now U.S. Pat. No. 5,092,733.

BACKGROUND OF THE INVENTION

1. Field of the Invention

The present invention relates to an excavator, particularly to an excavator provided with arms which are telescopically stretchable in the longitudinal direction thereof and a bucket for digging and removing earth and sand. A modified excavator is provided with a hook at the tip end of the arm.

2. Description of Prior Art

There has been widely used an excavator in an area where earth working, such as digging trenches or holes, is carried out (hereinafter referred to as the working area), which excavator comprises a boom having a slightly C-shaped configuration and swingably mounted on a movable body, an arm connected to the tip end of the boom and having a substantially linear shape so as to be vertically movable relative to the boom and a bucket mounted at the tip end of the arm. An excavator called a back hoe has been used widely in road construction and for burying objects. The boom, the arm and the bucket cooperate so that the bucket is pushed into the earth to dig the earth and sand and is raised to remove the dug earth and sand. The fundamental arrangement of the excavator is principally the same, namely, it includes three hydraulic cylinders cooperating with each other for carrying out the digging operation.

However, the conventional excavator has the following drawbacks.

A first drawback is that the length of the boom and the length of the arm, respectively, need to be extended to deepen the trench and the hole. Furthermore, when the earth and sand are picked and collected by the excavator at a river side, inasmuch as the lengths of the boom and the arm are fixed, the bucket cannot reach beyond a predetermined length so that the depth of digging and the length to reach the earth and sand are limited. It is theoretically possible to extend the lengths of the boom and the arm to dig deeper or to permit the bucket to reach a longer distance. However, if the lengths of the bucket and the arm are extended, the excavator becomes long as a whole which entails difficult transportation. In this case, if the boom is positioned perpendicularly relative to the mobile body so as to turn the bucket after collecting the earth and sand, the length of the boom becomes so long that it is liable to contact an electric wire or a construction structure.

That is, the first drawback is that it was impossible to lengthen the distance that the bucket extends from the movable body since the lengths of the boom and the arm are fixed and the connecting portions between the movable body, the boom, the arm and the bucket are merely operated at joints thereof. Hence, when the earth and sand is to be dug deeply, a long boom is necessitated, which is very inconvenient.

A second drawback is as follows. The conventional excavator has a function to dig deeply, which is very effective for mechanically digging a large volume of earth and sand and is very improved in the working efficiency compared with manpower. However, at the working area digging working is usually accomplished by burying working for burying pipes, including a Hume concrete pipe, to return to the original position or covering working for covering the dug trench or the hole by an iron plate. There is no problem to raise or lower materials having a weight that can be handled by manpower. However, in the case of heavy materials, such as the Hume concrete pipe or the iron plate, there is required an exclusive raising and lowering means, such as a crane, from the safety point of view. The crane meets the requirement of a safe standard of working.

It has been very rare to employ a working step that requires a crane in the working area in addition to an excavator. Furthermore, there seldom occurs the case that two vehicles having different functions occupy the same working area. When the working area comprises a main working area and a neighboring area, such as narrow side roads surrounding the main working area from which the excavator enters, only the excavator enters the working area for thereby preventing the crane from entering the working area. Still furthermore, since the operating hours of the crane are so short compared with those of the excavator, there is caused idle time for the crane even it if occupies the working area.

In the case of raising the heavy material during the operation of digging the earth and sand, a wire is hung from the bucket of the excavator and the heavy material is suspended by the wire. Thereafter the boom supporting the bucket is vertically moved to raise the heavy material. Although the operation to raise the heavy material is very simple, there is a likelihood that the wire will slip from the bucket since the excavator has no function inherently to raise the heavy material. This use of the excavator, which is different from the inherent use, as a crane, is involved in a dangerous working operation since the weight limit of the material to be suspended by the bucket is unknown.

In view of the inconvenience of the excavator, the applicant proposed an excavator, as disclosed in Japanese Patent Application No. 63-315787, having a crane incorporated in an excavator. The excavator having the contractible crane mechanism which is provided at the side of the arm or accommodated inside the arm is so structured that the crane is stretched from the arm when raising the heavy material and a wire is hung down from the tip end of the crane mechanism, then a hook is hung down from the tip end of the wire. With this arrangement, when the heavy material is not raised, the crane mechanism is contracted so as not to obstruct the digging operation by the bucket. Hence, this excavator is very convenient to use in a narrow working area since it carries out two functions by a single unit, namely, the function to raise the material and the function to dig the earth and sand.

The proposed excavator having the crane function has, however, the drawback that the crane mechanism is to be contracted so as not to hinder the digging operation and this entails a complicated mechanism. Furthermore, the crane mechanism is separately provided in addition to the arm and the boom which requires many manufacturing steps and high cost.

To solve the first drawback, the applicant proposed an excavator provided with telescopically stretchable arms and a bucket attached to a distal end of the arms. One of the arms can be lowered to the deepest position in the working area or extended to a longest position in the working area as disclosed in Japanese Patent Application No. 1-107990. However, the hydraulic cylinder for controlling the angular distance or position of the bucket relative to the arm is moved simultaneously with the movement of the inner arm relative to the outer arm. Hence, the hydraulic cylinder is so designed that a part of the hydraulic cylinder is movable relative to the outer arm and a base of the hydraulic cylinder is moved by the front or the rear wire in synchronism with the movement of the inner arm. However, this proposed excavator has such a drawback that the base of the hydraulic cylinder is not movable in synchronism with the inner arm since the front and the rear wires are all the time stretched, which entails a complicated mechanism.

SUMMARY OF THE INVENTION

To solve the first drawback of the conventional excavator, an excavator according to a first aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, and a synchronous means for moving the base end of the outer arm for the length corresponding to the telescopical stretchable length of the inner arm.

To solve the second drawback of the conventional excavator, an excavator according to a second aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, a synchronous means for moving the base end of the outer arm for the length corresponding to the telescopical stretchable length of the inner arm and a hook mechanism mounted at a front portion of the inner arm.

To solve the third drawback of the conventional excavator, an excavator according to a third aspect of the present invention comprises a movable body, a boom mounted at one end thereof on a front portion of the movable body, first hydraulic cylinders mounted at one end thereof on the front portion of the movable body, the first hydraulic cylinders being provided with piston rods connected at the tip ends thereof with substantially the central portion of the boom for moving the boom swingably in the longitudinal direction thereof, an outer arm pivotally swingably mounted on the other end of the boom, a second hydraulic cylinder mounted on a rear surface of the boom, the second hydraulic cylinder being provided with a piston rod connected to a rear portion of the outer arm for correcting an angular distance between the boom and the outer arm, an inner arm inserted into the outer arm and movable telescopically relative to the outer arm in the longitudinal direction of the outer arm, a bucket connected to the tip end of the inner arm, a bucket cylinder provided with a piston rod and having one end connected to the bucket, a guide mechanism slidably mounted on guide plates fixed to the outer arm and connected to the rear end of the bucket cylinder for operating the bucket cylinder to thereby stretch the piston rod from the bucket cylinder so that the angular distance between the bucket and the inner arm is kept unchanged with synchronism with the amount of movement of the inner arm, a third hydraulic cylinder connected to a base end of the outer arm at the base thereof and having a rod connected to a central portion of the inner arm for moving the inner arm relative to the outer arm, a synchronous means for moving the base end of the outer arm for the length corresponding to the telescopical stretchable length of the inner arm, and interlocking means connected between the guide mechanism and the front portion of the inner arm.

The above and other objects, features and advantages of the present invention will become more apparent from the following description taken in conjunction with the accompanying drawings.

PREFERRED EMBODIMENTS OF THE INVENTION

First Embodiment (FIGS. 1 to 8)

Figure 1:
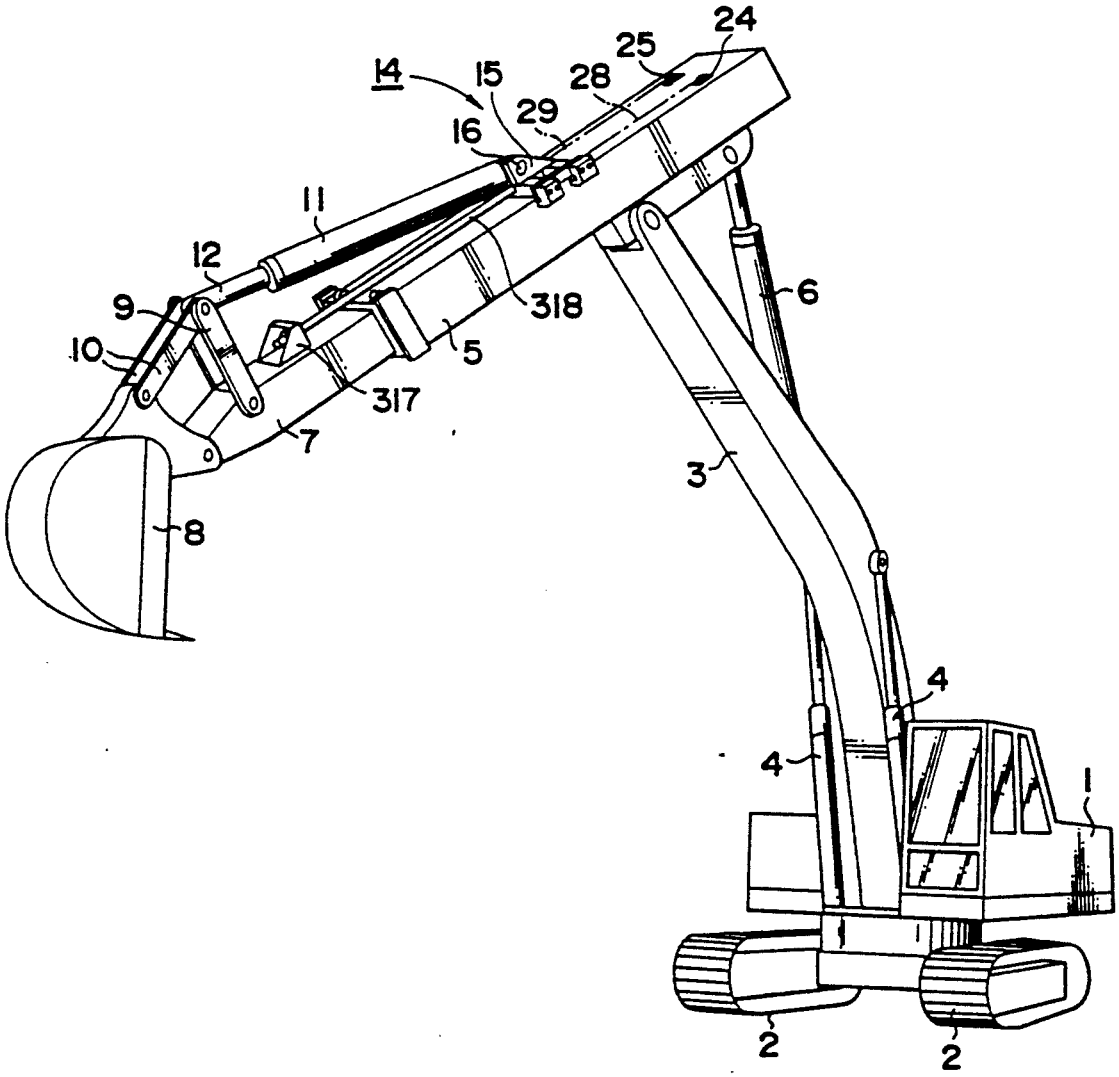
FIG. 1 is a perspective view of an excavator according to a first embodiment of the present invention.

An excavator according to a first embodiment will be described with reference to FIGS. 1 to 8.

The excavator comprises a movable body 1, a boom 3 mounted at one end thereof on a front portion of the movable body 1, first hydraulic cylinders 4 mounted at corresponding first ends thereof on the front portion of the movable body 1, the first hydraulic cylinders being provided with cylinder rods connected at the tip ends thereof with substantially the central portion of the boom 3 for moving the boom 3 vertically swingably in the longitudinal direction thereof, an outer arm 5 pivotally swingably mounted on the other end of the boom 3, a second hydraulic cylinder 6 mounted on the rear surface of the boom 3, the second hydraulic cylinder 6 being provided with a piston rod connected to the rear portion of the outer arm 5 for correcting an angular distance between the boom 3 and the outer arm 5, an inner arm 7 inserted into the outer arm 5 and movable telescopically relative to the outer arm 5 in the longitudinal direction of the outer arm 5, a bucket 8 connected to the tip end of the inner arm 7, a bucket cylinder 11 provided with a piston rod 12 and having one end connected to the bucket 8, a guide mechanism 14 slidably mounted on guide plates fixed to the outer arm 5 and connected to the rear end of the bucket cylinder for operating the bucket cylinder to thereby extend the piston rod from the bucket cylinder 11 so that the angular distance between the bucket 8 and the inner arm 7 is kept unchanged in synchronism with the amount of movement of the inner arm 7, a third hydraulic cylinder 17 connected to a base end of the outer arm 5 at the base thereof and having a piston rod 18 connected to a central portion of the inner arm 7 for moving the inner arm 7 relative to the outer arm 5, a synchronous means for moving the base end of the outer arm 5 for the length corresponding to the telescopical stretchable length of the inner arm 7, and interlocking means connected between the guide mechanism and the front portion of the inner arm 7.

The excavator will be described more in detail. The body 1 accommodates thereon hydraulic generator, etc., and a pair of crawlers 2 are provided under the body 1 at the right and the left sides thereof so that the body 1 is movable by the pair of crawlers.

The boom 3 is pivotally mounted on the front of the body 1 at one end thereof and is curved slightly at the central portion thereof. The first hydraulic cylinders 4 having piston rods are mounted on the front of the body 1 at respective one ends thereof and are positioned to support the boom 3 and are connected to the boom 3 by the piston rods at the central portion thereof for moving the boom 3 angularly relative to the body 1.

The linear outer arm 5 is swingably mounted at the other end of the boom 3. The second hydraulic cylinder 6 is interposed between the rear portion of the outer arm 5 and the rear surface of the boom 3 for changing the angle between the outer arm 5 and the boom 3. The outer arm 5 is made of a steel plate, is hollow and is square in cross section. The inner arm 7 having the same shape as the outer arm 5 is inserted in the outer arm 5 so as to be slidable inside the outer arm. The bucket 8 is swingably mounted on the tip end of the inner arm 7. Levers 9, 10 are attached to the tip end of the inner arm 7 and the rear portion of the bucket 8, respectively, for forming a linkage mechanism. The levers 9, 10 are connected with each other at the tip ends thereof and form an angle having an apex to which the piston rod 12 of the bucket cylinder 11 is connected. A pair of trapezoidal shaft supporting plates 15 are fixed to the slider 14 with a predetermined spacing therebetween. The base of the bucket cylinder 11 is inserted between the pair of supporting plates 15 and is pivotally connected to the pair of supporting plates 15 by a pin 16.

Figure 2:
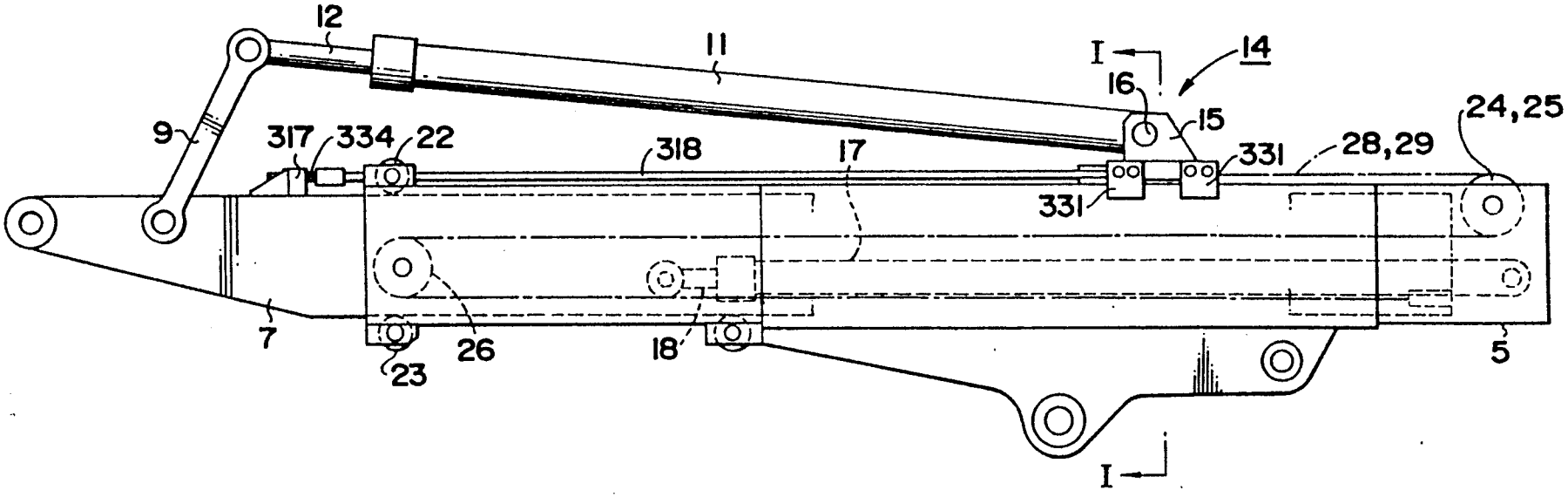
FIG. 2 is a side view showing an internal arrangement of an outer arm, a constituent of the excavator of FIG. 1.
Figure 3:
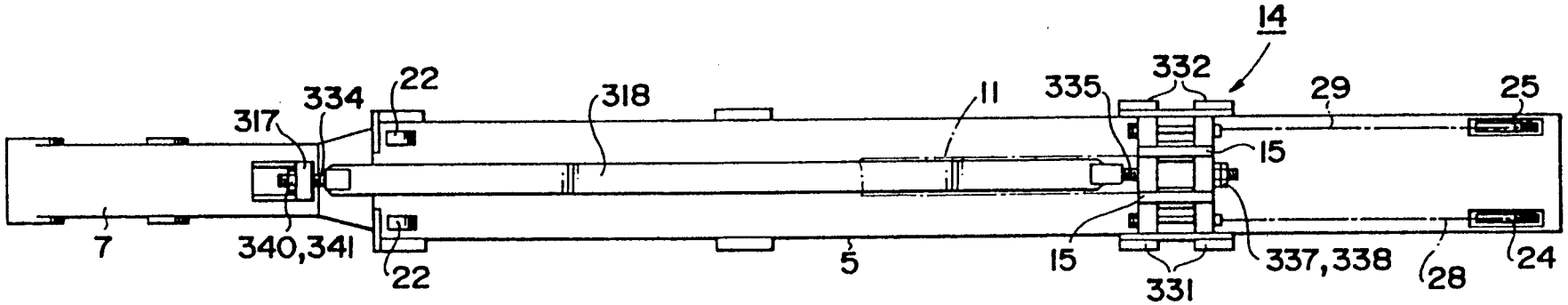
FIG. 3 is a plan view of FIG. 2.
Figure 4:
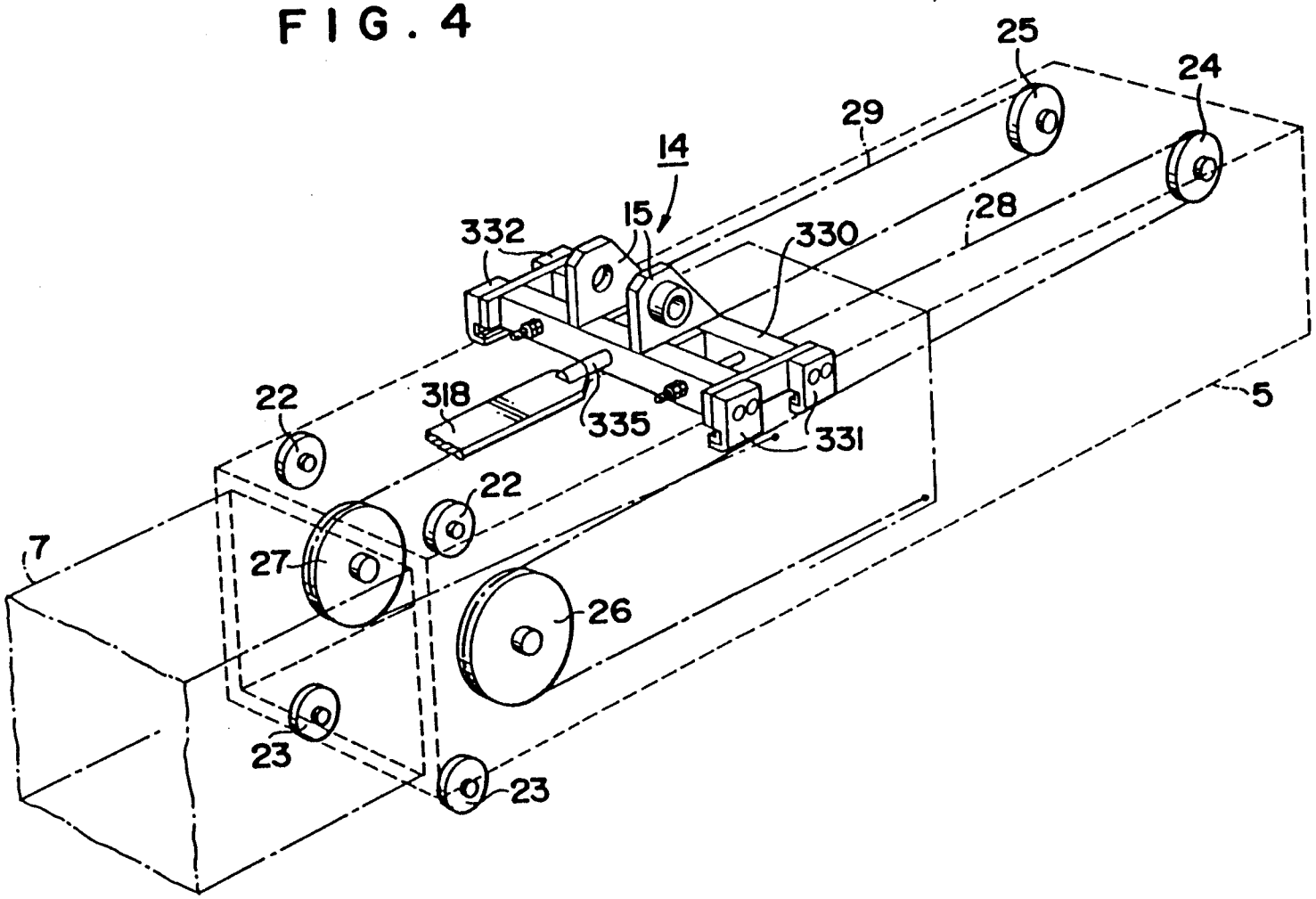
FIG. 4 is a perspective view of assistance in explaining the arrangement of the synchronous mechanism, a constituent of the excavator of FIG. 1.

In FIG. 2, the inner arm 7 has the third hydraulic cylinder 17 disposed in parallel with a longitudinal direction thereof for telescopically extending the inner arm 7. The third hydraulic cylinder 17 is fixed to the rear end of the outer arm 5 at the base portion thereof (right side in FIG. 2) and the piston rod 18 of the third hydraulic cylinder 17 is connected to the central portion of the inner arm 7.

The synchronous means will be described hereinafter.

Rollers 22, 23 having respectively small diameters are supported at the upper and lower surfaces of the tip end of the outer arm 5 so that the inner arm 7 can be smoothly moved relative to the outer arm 5. Sprocket wheels 24, 25 are supported at the rear end of the outer arm 5 and at both sides thereof, with the upper half surface thereof being exposed above the upper surface of the outer arm 5. Sprocket wheels 26, 27 are supported by the outer arm 5 at the inner end thereof and adjacent to both sides of the inner arm 7. The chain 28 is connected to the rear end of the slider 14, is inverted by the sprocket wheel 24, extends through the space between the inner arm 7 and the outer arm 5, and extends in the direction of the bucket 8 and is further inverted by the sprocket wheel 26. The chain 28 is connected to the rear end of the inner arm 7. The chain 29 is connected to the slider 14 at the rear end thereof, is inverted by the sprocket wheel 25, extends through the space between the inner arm 7 and the outer arm 5, extends in the direction of bucket 8, and is further inverted by the sprocket wheel 27. The chain 29 is connected to the rear end of the inner arm 7 at the rear end thereof.

The structure of the slider 14 will be described more in detail with reference to FIGS. 5 and 6.

The outer arm 5 comprises a barrel 355 made of a steel plate bent in C-shape and a roofed portion 356 fixed to the barrel 355 so as to close the opening in the upper side of the barrel 355. The roofed portion 356 has both ends respectively protruding beyond both side surfaces of the barrel 355 and assembled with the slider 14 for preventing the slider 14 being dropped from the both ends of the roofed portion 356.

The slider 14 as the guiding mechanism comprises a substantially H-shaped body 330 having a width at the central portion thereof the same as the width of the outer arm 5. Sliding bodies 357 made of MC nylon and the like are fixed to the lower surface of the body 330 and the lower surfaces of bodies 357 contact the upper surface of the roofed portion 356 so that the slider 14 can be smoothly slid by the sliding bodies 357. The shaft supporting plates 15 are disposed in parallel with a predetermined spacing therebetween and are fixed to the upper surface central portion of the body 330. The bucket cylinder 11 is inserted between the pair of shaft supporting plates 15 at the base thereof. Flat shaped attaching plates 358, 359 are fixed to the both sides of the body 330 and have guide bodies 331, 332 fixed thereto by screws 360, 361 for engaging with the roofed portion 356.

Guide bodies 331, 332 have respectively recessed portions 362, 363 formed in C-shape at the lower inside portions thereof. The recessed portions 362, 363 have respectively L-shaped sliding members 364, 365 made of MC nylon and the like and engaged in the inner walls thereof. The sliding members 364, 365 can guide the slider 14 while they contact the end portions of the roofed portion 356. The slider 14 can be moved without slipping off the roofed portion 356, namely, the upper side of the outer arm 5. A connecting through hole 333 penetrates the central portion of the body 330 horizontally so as to extend perpendicular relative to the longitudinal direction of the body 330. Joint holes 366, 367 are defined at right and left sides of the connecting through hole 333 by penetrating the body 330.

An interlocking bar 318 is made of a thin metal band having high rigidity and has fixing screws 334, 335 fixed to the front end and the rear end thereof by welding and the like for applying tension thereto. The fixing screw 335 is inserted into the connecting through hole 333 and screwed in double by nuts 337, 338 at the rear portion of the body 330 and is thereby fixed to the body 330. The fixing screw 334 is inserted into a hole 339 defined by an opening in a perpendicular member of a fixing member 317 and screwed in double by nuts 340, 341 and is thereby fixed to the fixing member 317. The interlocking bar 318 adjusts the spacing between the fixing member 317 and the slider 14 by the fixing screws 334, 335 and the tension can be determined freely by adjusting the nuts 337, 338, 340, 341.

The chains 28, 29 are connected to long screws 368, 369 at the tip ends thereof. The long screw 368 is inserted into the joint hole 366 and is screwed in double by nuts 370 and is thereby fixed to the body 330 at the rear portion thereof. The long screw 369 is inserted into the joint hole 367 and screwed in double by nuts 371 and is thereby fixed to the body 330 at the rear portion thereof.

The operation of the excavator according to the first embodiment will be described hereinafter.

The crawlers 2 are driven to move the movable body 1 toward the place where the trenches and the holes are to be dug. The bucket 8 is positioned at the location where the earth and sand is dug and the first, the second and the third hydraulic cylinders 4, 6 and 17, and the bucket cylinder 11 are operated in interlocking manner to thereby turn the bucket 8 so that the bucket 8 can dig the earth and sand. The operation is the same as that of conventional excavators.

Figure 7:
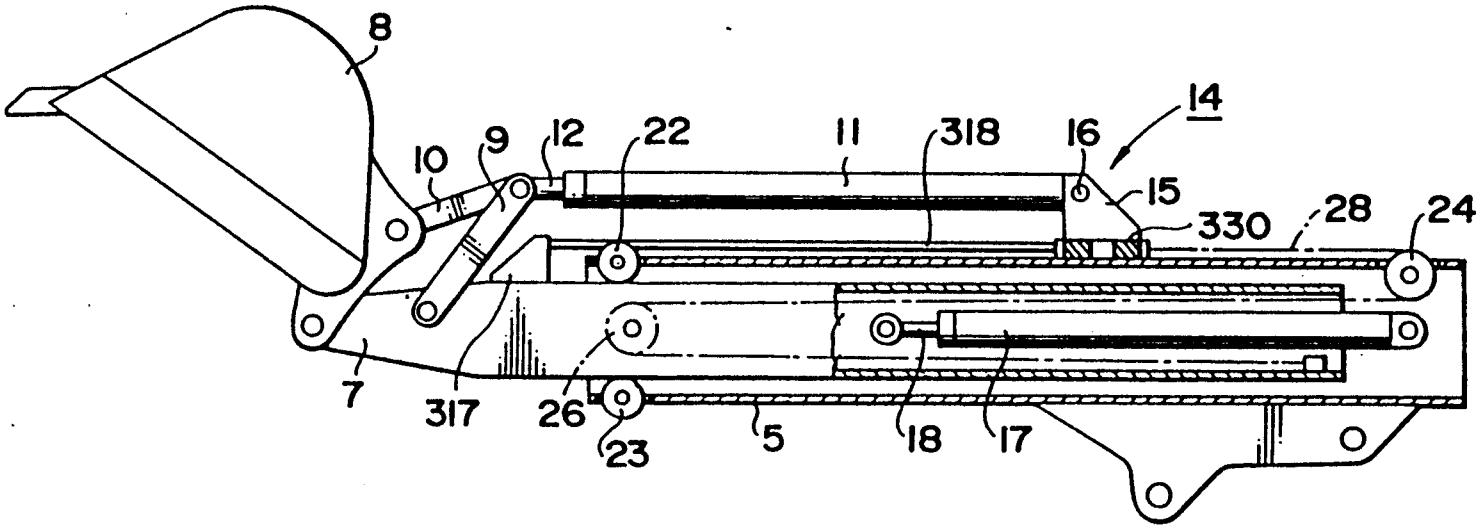
FIG. 7 is a side view, partially in cross section, of assistance in explaining the contracted state of an inner arm where the inner arm is drawn into an outer arm, the inner arm and the outer arm being constituents of the excavator of FIG. 1.
Figure 8:
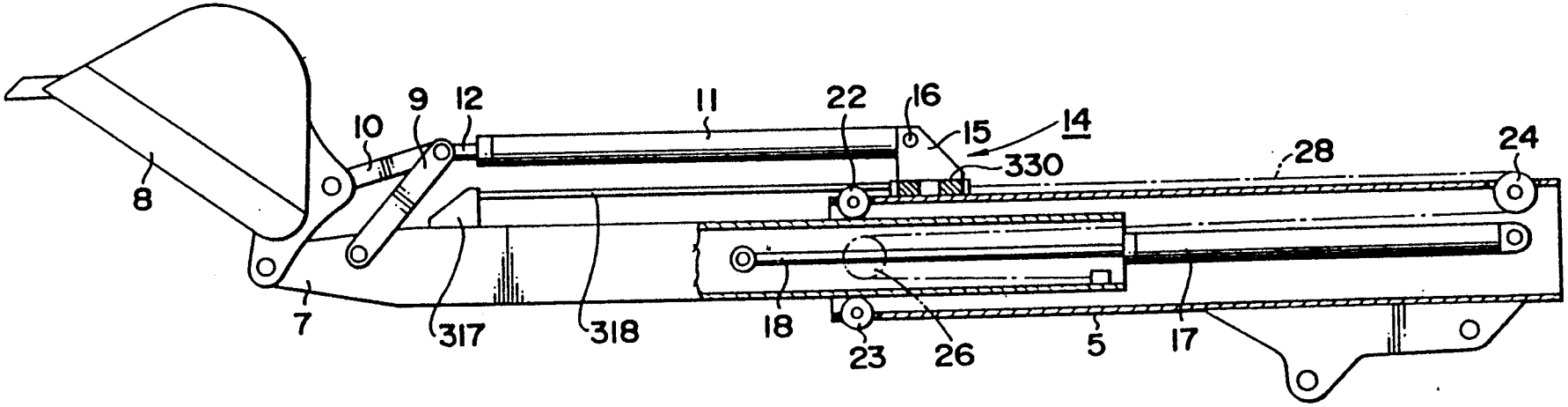
FIG. 8 is a side view, partially in cross section, of assistance in explaining the state where the inner arm is stretched the maximum extent from the outer arm compared with the state of FIG. 7.

When the trenches or the holes are to be deepened, the bucket 8 is controlled to be moved to the deeper position. At this time, the third hydraulic cylinder 17 receives the oil under pressure and pushes the piston rod 18 and the inner arm 7 forwardly. The piston rod 18 is extended from the third hydraulic cylinder 17 for thereby pushing the inner arm 7 out of the outer arm 5, hence the inner arm 7 is slid from the position as illustrated in FIG. 7 to the position as illustrated in FIG. 8. Accordingly, the bucket 8 is moved to the position which is located far from the base portion of the outer arm 5 so that the bucket 8 will reach the deepest position and dig the earth and sand therein.

At this time when the inner arm 7 is moved away from the outer arm 5, the interlocking bar 318 fixed to the tip end of the inner arm 7 pulls the slider 14 to thereby move the slider 14 on the upper surface of the outer arm 5 in the longitudinal direction thereof. With the movement of the slider 14, the guides 331, 332 fixed to both the sides of the body 330 contact and are guided by both the sides of the outer arm 5, hence the slider 14 is not moved off the upper surface of the outer arm 5. The slider 14 moves with synchronism with the movement of the inner arm 7 for the same amount of movement as the inner arm 7. When the third hydraulic cylinder 17 is operated to push the inner arm 7 out of the outer arm 5 due to extension of the piston rod 18, the bucket 8 is maintained at the same angular distance relative to the inner arm 7 since the bucket cylinder 11 is moved simultaneously with the extension of the piston rod 18 whereby the excavating operation can be made without difficulty.

When the earth and sand dug by the bucket 8 are raised, the third hydraulic cylinder 17 is first operated to pull the piston rod 18. The inner arm 7 is moved into the inner portion of the outer arm 5. Inasmuch as the chains 28, 29 are connected to the rear portion of the inner arm 7, the chains 28, 29 are moved in the direction of the base of the outer arm 5 and inverted by the sprocket wheels 26, 27 and further inverted by the sprocket wheels 24, 25 and moved for thereby moving the slider 14 in the direction of the base of the outer arm 5.

Accordingly, when the inner arm 7 is moved in the same manner set forth above, the bucket cylinder 11 is synchronized with the inner arm 7 and is extended for the same amount of movement whereby the bucket 8 is moved consequently while the angular distance of the bucket 8 relative to the inner arm 7 is kept the same. Hence, the earth and sand so dug is not dropped from the bucket 8. Thereafter, the first and the second hydraulic cylinders 4, 6 and the bucket cylinder 11 are interlocked with each other so that the earth and sand dug by the bucket 8 is loaded on a truck which is standing by at the rear side of the movable body 1 or moved and shifted to another portion.

Figure 9:
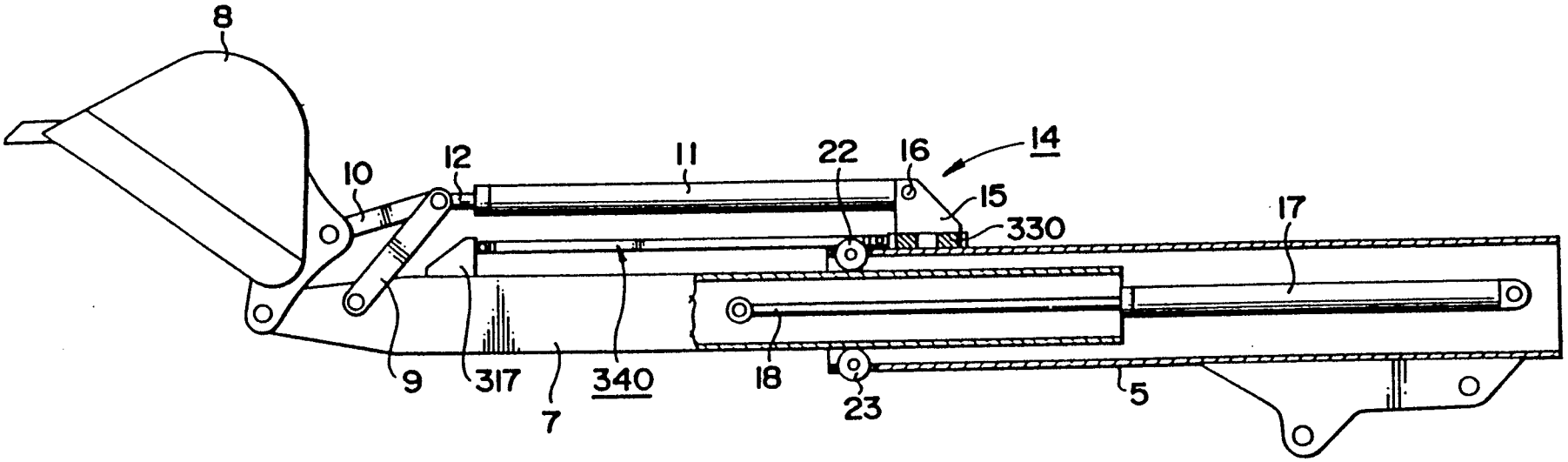
FIG. 9 is a side view, partly cut away, of an outer arm, a constituent of an excavator according to a second embodiment of the present invention.
Figure 10:
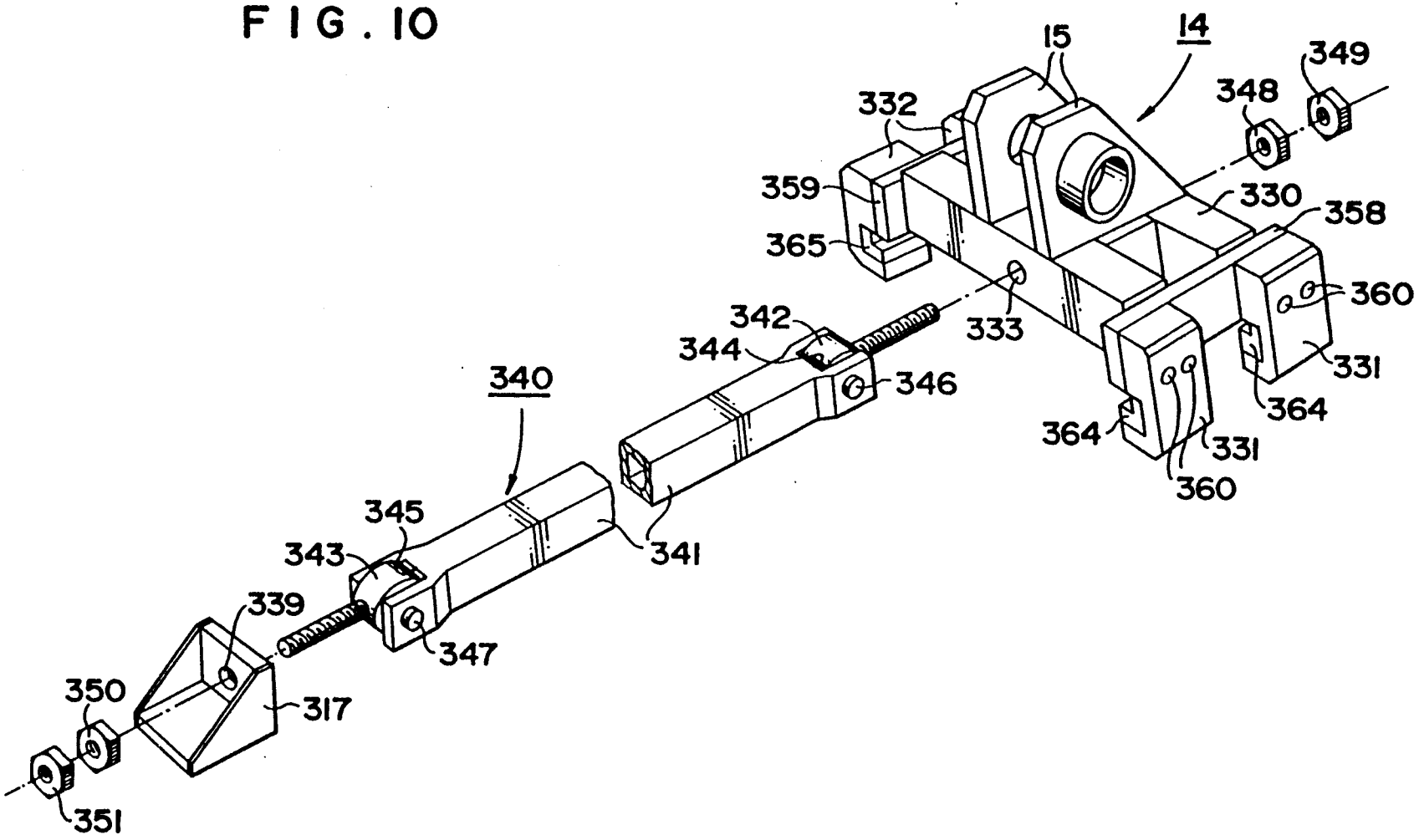
FIG. 10 is an exploded perspective view of a synchronous mechanism of FIG. 9.
Figure 11:
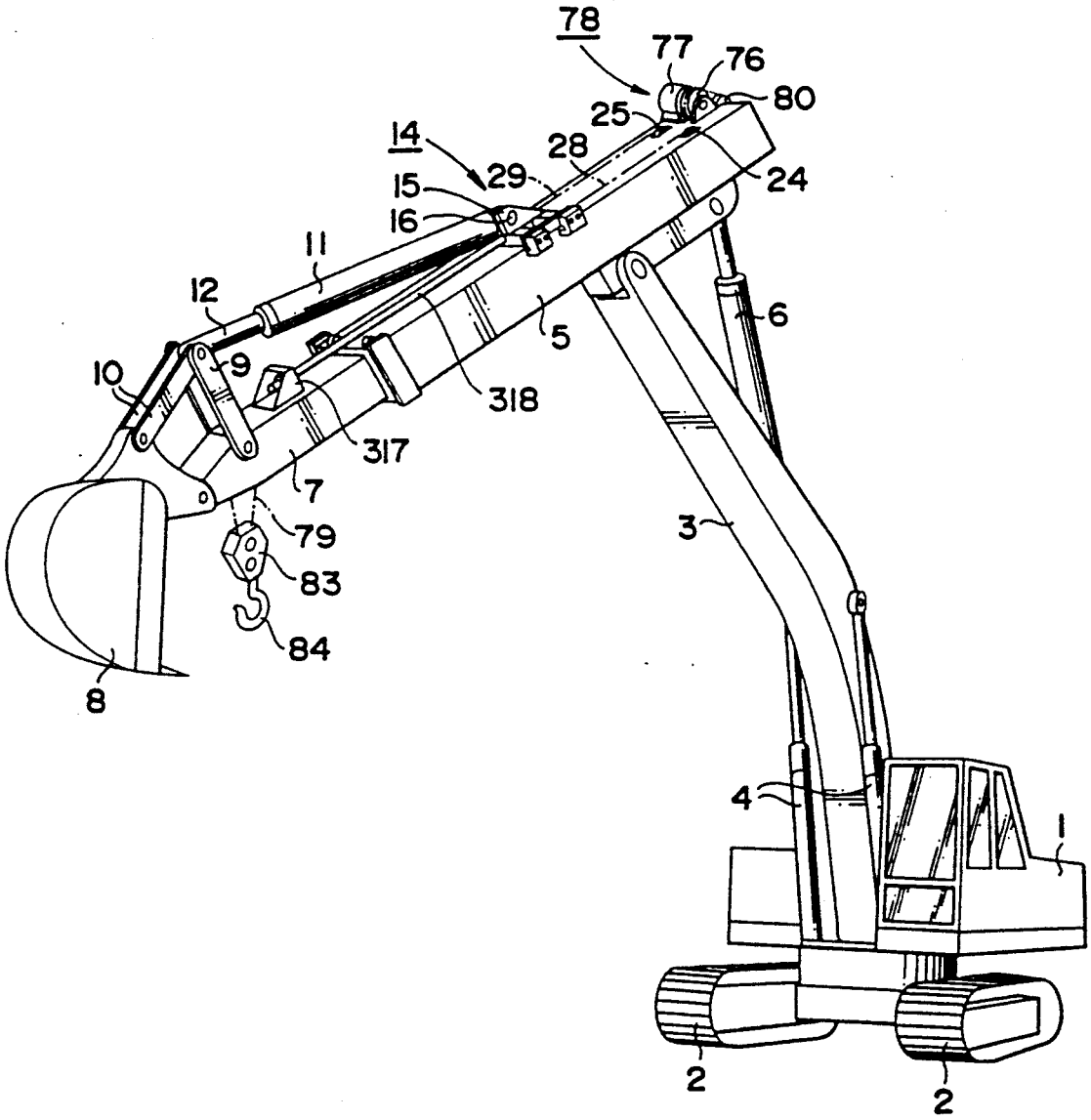
FIG. 11 is a perspective view of an excavator according to a third embodiment of the present invention.
Figure 12:
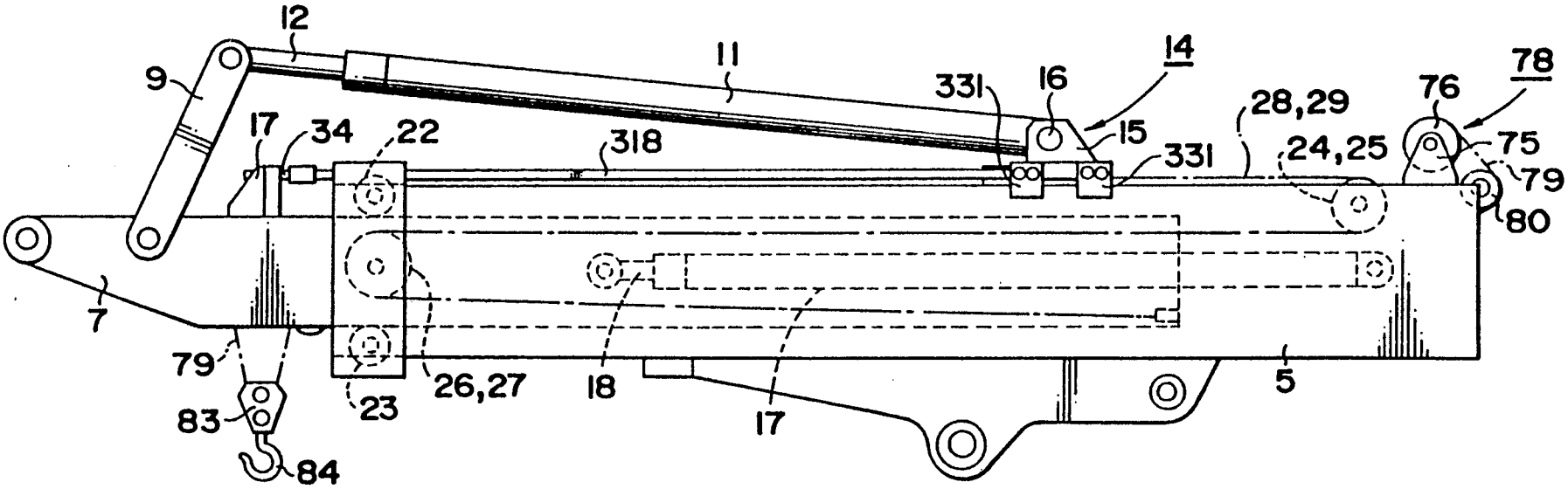
FIG. 12 is a perspective view showing an outer arm and an inner arm, constituents of the excavator of FIG. 11.
Figure 13:
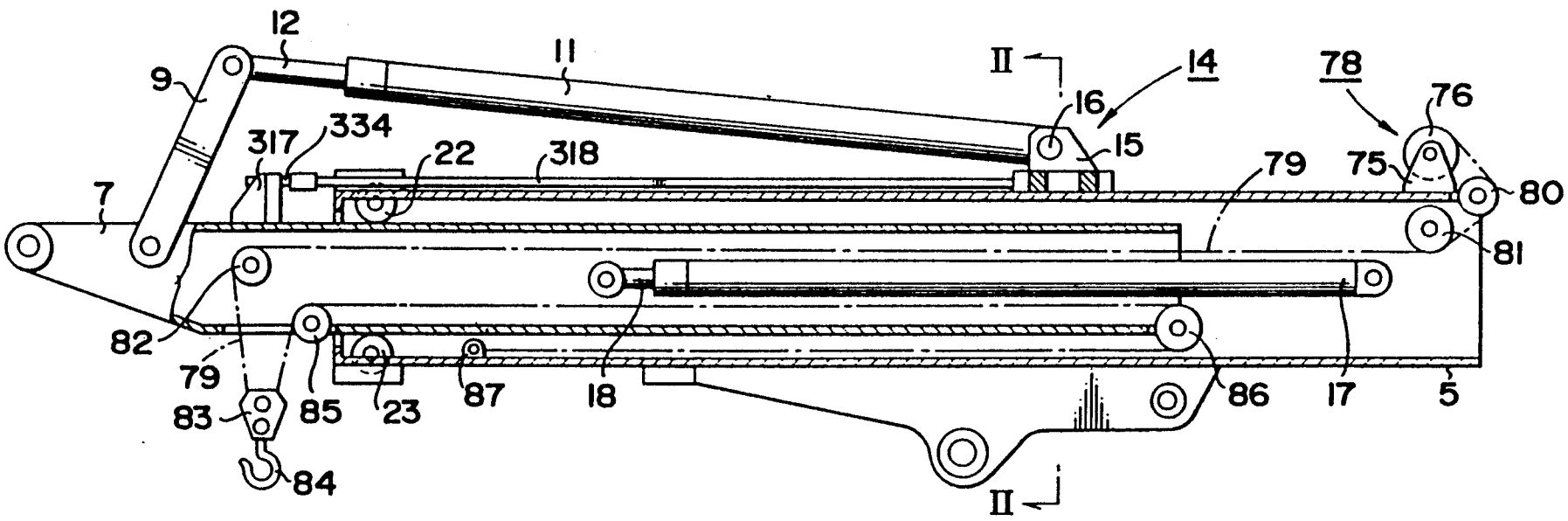
FIG. 13 is a side view, partially in cross section, of FIG. 12.
Figure 14:
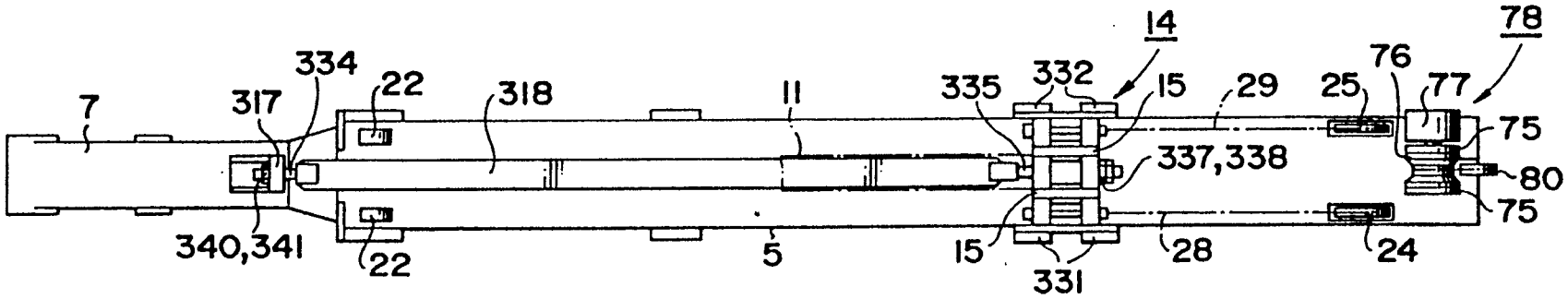
FIG. 14 is a plan view of FIG. 12.
Figure 15:
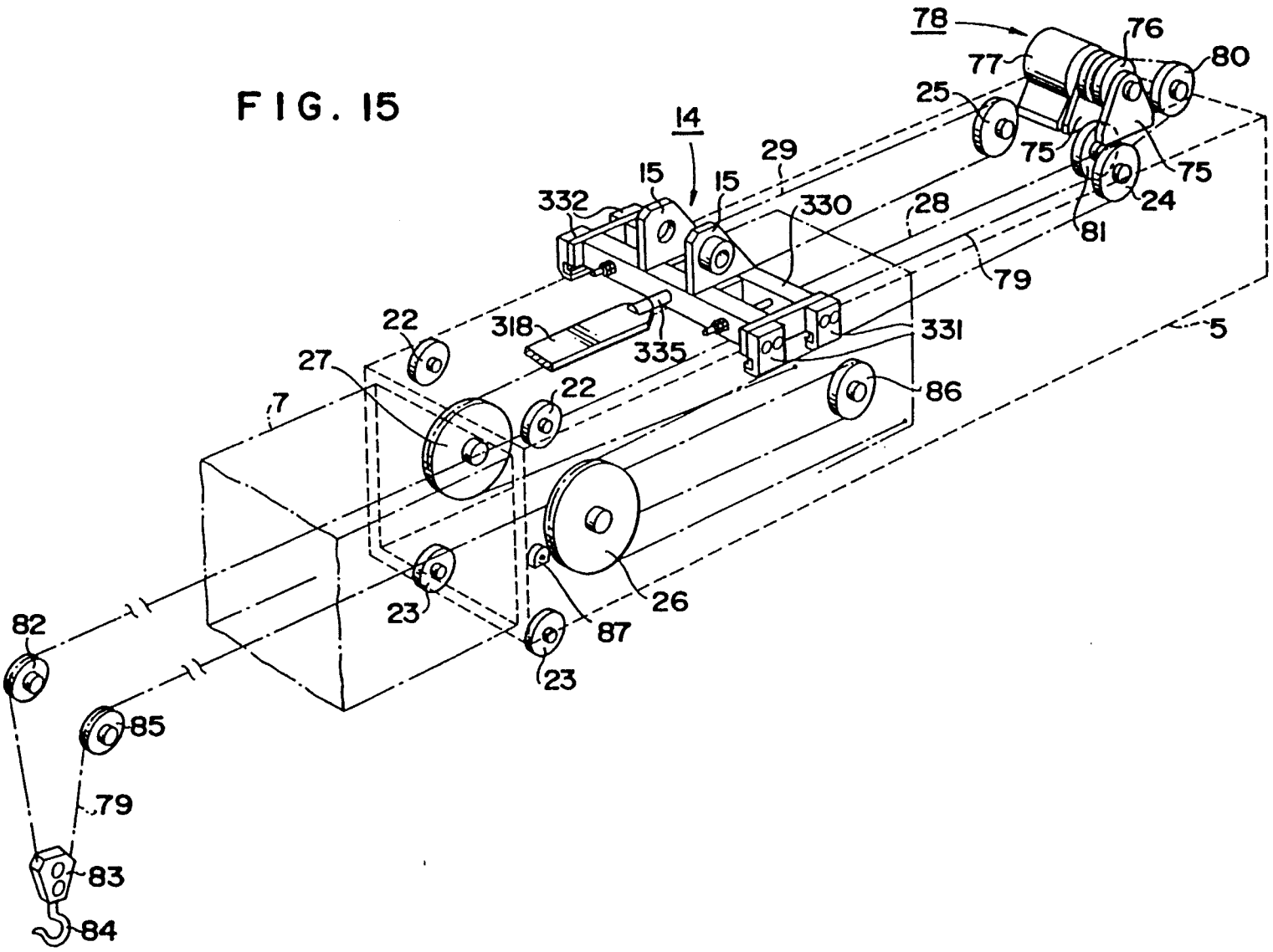
FIG. 15 is a perspective view showing the state of winding of the cable.

Second Embodiment (FIGS. 9 and 10)

An excavator having a modified synchronous mechanism according to a second embodiment will be described with reference to FIGS. 9 and 10.

A fixing member 317 having a substantially triangular shape is fixed to the inner arm 7 close to the lever 9 and is connected to the body 330 of the slider 14 by a connecting body 340 having a square shape in cross section. The interlocking mechanism has no chains connected to the rear portion of the slider 14.

The connecting body 340 comprises a rod 341 and fixing bolts 342, 343 connected to the opposite ends of the rod 341. The rod 341 is hollow, square shaped in cross section and has inserting grooves 344, 345 at the opposite ends thereof. The fixing bolt 342 is inserted into the inserting groove 344 and is connected to the rod 341 by a pin 346. The fixing bolt 343 is inserted into the inserting groove 345 and is connected to the rod 341 by a pin 347.

The threaded portion of the fixing bolt 342 is inserted into the connecting hole 333 and screwed in double by fixing nuts 348, 349 so that the fixing bolt 342 is fixed firmly to the body 330 by the fixing nuts 348, 349. The threaded portion of the fixing bolt 343 is inserted into the fixing hole 339 of the fixing member 317 and screwed in double by two nuts 350, 351 at the rear portion of the fixing member 317 so that the fixing bolt 343 is firmly fixed to the fixing member 317 by the fixing bolt 343. With such an arrangement, the rod 341 is swingable vertically about the pins 346, 347 but is not extended or contracted in the longitudinal direction thereof. That is, the rod 341 is formed as a rigid structure unable to be extended or contracted in the longitudinal direction thereof.

When the third hydraulic cylinder 17 is operated to push the piston rod 18 out of the third hydraulic cylinder 17, the rod 341 is pulled by the fixing member 317 and the body 330 of the slider 14 is also pulled so that the base of the bucket cylinder 11 is moved with the angle of the bucket 8 relative to the inner arm 7 being not changed. When the third hydraulic cylinder 17 is operated to contract the piston rod 18, the inner arm 7 connected to the piston rod 18 is drawn inside the outer arm 5. Since the rod 341 fixed to the fixing member 317 is rigid, the rod 341 pushes the body 330 while the length of the rod 341 is not contracted whereby the base of the bucket cylinder 11 is pushed upward toward the rear portion of the outer arm 5. Accordingly, it is possible to move the base of the bucket cylinder 11 in synchronism with the movement of the inner arm 7 while the bucket is kept in the same angular position relative to the inner arm 7. That is, the bucket cylinder 11 can be moved as if the ordinary bucket 8 can be operated.

Differing from the first embodiment of the present invention, the excavator according to the present invention reduces parts of the constituents thereof and is simplified.

Third Embodiment (FIGS. 11 to 19)

An excavator according to the third embodiment will be described hereinafter.

A movable body 1 houses therein an engine, hydraulic generators and the like and crawlers 2 under the movable body 1 at the right and left sides thereof by which the movable body 1 can be freely moved. A boom 3 having substantially a C-shape is mounted at one end thereof on a front portion of the movable body and first hydraulic cylinders 4 are mounted at one ends thereof on the front portion of the movable body 1. The first hydraulic cylinders 4 are provided with cylinder rods connected at the tip ends thereof with substantially the central portion of the boom 3 for moving the boom 3 swingably relative to the longitudinal direction thereof. An outer arm 5 having a linear shape is pivotally swingably mounted on the other end of the boom 3. A second hydraulic cylinder 6 is mounted on the rear surface of the boom 3 and is provided with a piston rod connected to a rear portion of the outer arm 5 for correcting the angular relationship between the boom 3 and the outer arm 5. The outer arm 5 is formed by bending a steel plate and is substantially square in cross section. An inner arm 7 is inserted into the outer arm 5 and is movable telescopically relative to the outer arm 5 in the longitudinal direction of the outer arm 5. A bucket 8 is swingably connected to the tip end of the inner arm 7. A bucket cylinder 11 is provided with a piston rod 12. Links 9 and 10 are connected to the tip end of the inner arm 7 and the rear end of the bucket 8, respectively, for forming a link mechanism and are connected to each other at the tip ends thereof for forming an angular shape having an apex. The tip ends thereof, i.e. the apex of the linkage is connected to the piston rod 12 of the bucket cylinder 8. A slider 14 is provided on the upper surface of the outer arm 5 and is capable of moving along the longitudinal direction thereof. A pair of substantially trapezoidal shaft supporting plates 15 are fixed to the slider 14 with a predetermined spacing therebetween. The base of the bucket cylinder 11 is inserted between the shaft supporting plates 15 and the shaft supporting plates 15 and the bucket cylinder 11 are connected to each other by a pin 16.

A fixing member 317 having a substantially triangular shape is fixed to the tip portion of the inner arm 7 at the portion adjacent to the link 9. A substantially flat shaped interlock bar 318 is interposed between the fixing member 317 and the slider 14.

A cable 79 is suspended from the lower portion of the tip end of the inner arm 7 and a hook body 83 having a hook 84 is wound around the cable 79. The cable 79 extends into the inner portions of the inner arm 7 and the outer arm 5. One end of the wire 79 is pulled out from the rear end opening of the outer arm 5 and is wound around a drum 76 of a hoist mechanism 78.

The inner arm 7 has inside thereof a third cylinder 17 for telescopically moving the inner arm 7, a base of which is fixed to the rear end of the outer arm 5 (right sides in FIGS. 12 and 13) and a piston rod 18 of the third hydraulic cylinder 17 is connected to a central inner side of the inner arm 7.

Rollers 22, 23 having respectively small diameters are supported at the upper and lower surfaces of the tip end of the outer arm 5 so that the inner arm 7 can be smoothly moved relative to the outer arm 5. Sprocket wheels 24, 25 are supported at the rear end of the outer arm 5 and at both sides thereof with the upper half surface thereof being exposed over the upper surface of the outer arm 5. Sprocket wheels 26, 27 are supported by the outer arm 5 adjacent to both sides of the inner arm 7 at the outer end thereof. A chain 28 is connected to the rear end of the slider 14 at the tip end thereof and is inverted by the sprocket wheel 24 to thereby be inserted into the space between the inner arm 7 and the outer arm 5, and extends in the direction of the bucket 8 and further inverted by the sprocket wheel 26. The chain 28 is connected to the rear end of the inner arm 7. A chain 29 is connected to the slider 14 at the rear end thereof, is inverted by the sprocket wheel 25, thereby being inserted in the space between the inner arm 7 and the outer arm 5, extends in the direction of bucket 8, is further inverted by the sprocket wheel 27. The chain 29 is connected to the rear end of the inner arm 7.

The hoist mechanism 78 comprises a drum 76 for winding the cable 79 therearound and a hydraulic motor 77. A pair of shaft supporting plates 75 are fixed to the upper surface of the rear portion of the outer arm 5 with a given spacing therebetween so that the drum 76 is rotatably supported therebetween. The hydraulic motor 77 is placed on the upper surface of the rear end of the outer arm 5 at the portion adjacent to the shaft supporting plates 75. The drum 76 is driven by the hydraulic motor 77. The cable 79 is wound around the periphery of the drum 76. The cable 79 is guided by a pulley 80 supported at the rear end of the outer arm 5 into the inner portion of the outer arm 5. A pulley 81 is supported at the inner rear portion of the outer arm 5 and a cable holder 87 is fixed to the portion adjacent to the inner lower surface of the outer arm 5. Pulleys 82 and 85 are supported at the tip portion of the inner arm 7 while a pulley 86 is supported at the rear end of the inner arm 7 for reversing the cable 79. The cable 79 is guided by the pulley 80, contacts the outer periphery of the pulley 81, is further guided inside the inner arm 7 to be parallel with the longitudinal direction of the inner arm 7, then contacts the pulley 82, thereafter being directed downwardly. The hook body 83 is suspended by the cable 79 so as to hang downwardly from the tip end of the inner arm 7 while the cable 79 is wound around the hook body 83, is directed upward and then is guided inside the inner arm 7. When the cable 79 contacts the pulley 85, it is directed rearwardly through the inner arm 7, is reversed by the pulley 86 provided at the rear end of the inner arm 7 and the tip end of the cable 79 is connected to the wire holder 87. The cable 79 thus pulled out from the drum 76 is circulated inside the inner arm 7 while it has an overall substantially S-shape.

Figure 5:
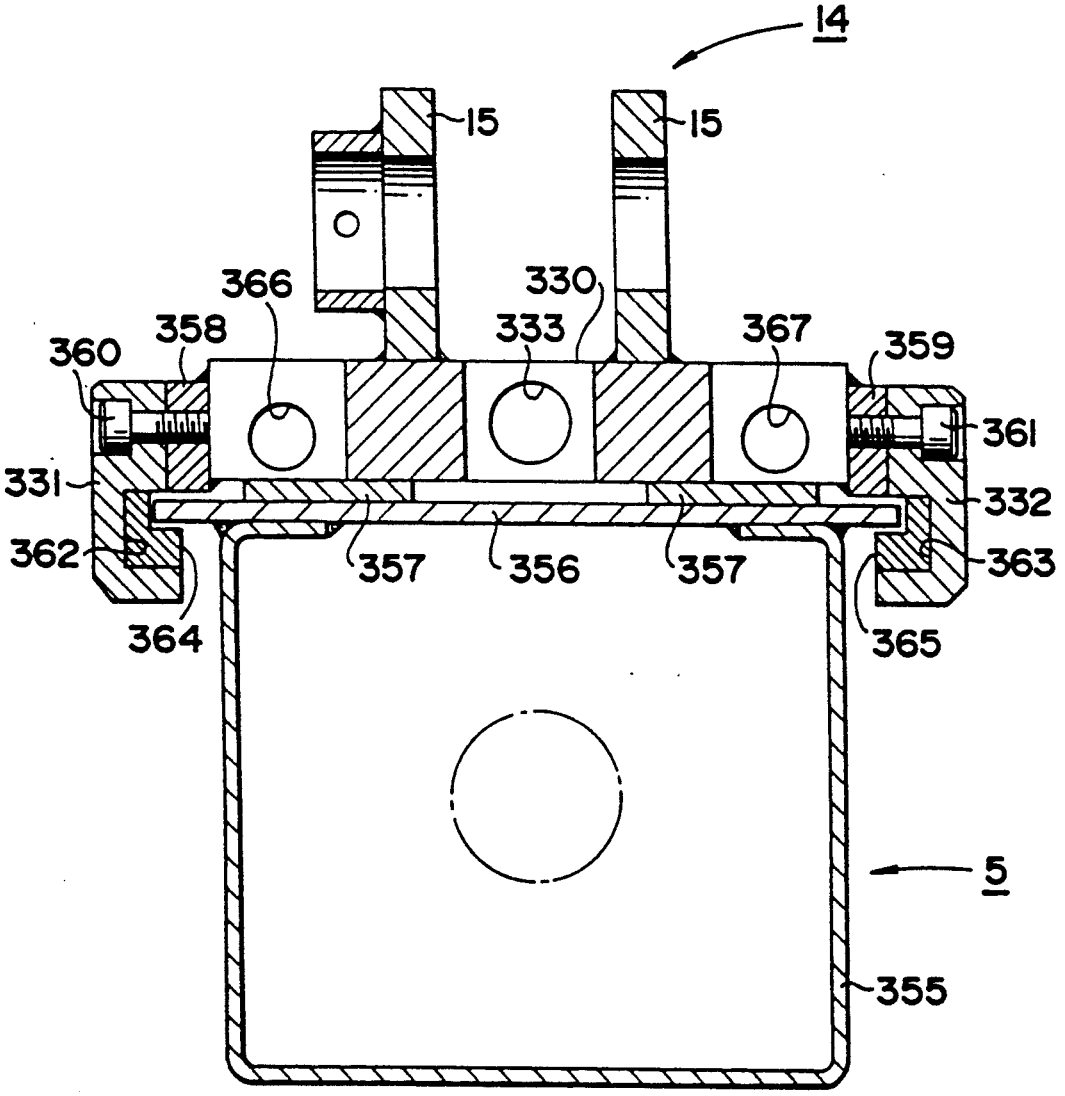
FIG. 5 is a cross sectional view taken along the section line A—A of FIG. 2.
Figure 6:
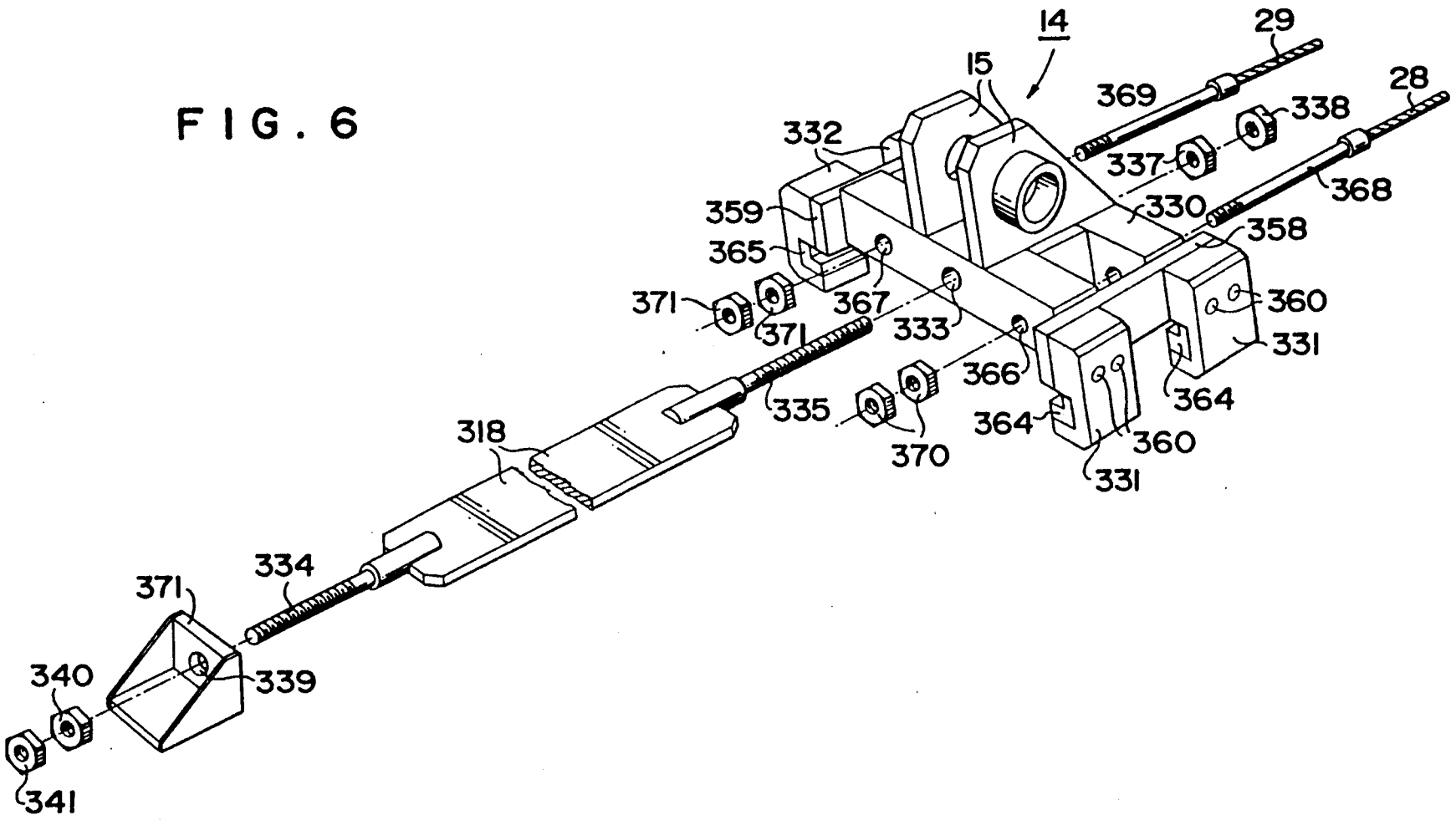
FIG. 6 is an exploded perspective view of assistance in explaining an arrangement of a synchronous mechanism of FIG. 4.

The structure of the slider 14 and the arm 5 are the same as described for the first embodiment, referring to FIGS. 5 and 6, and, therefore, further description thereof is omitted.

The operation of the excavator according to the third embodiment will be described hereinafter.

(Excavating operation by the bucket)

The crawlers 2 are driven to move the movable body 1 toward the place where the trenches and the holes are to be dug. The bucket 8 is positioned at the location where the earth and sand are to be dug and the first and the second hydraulic cylinders 4, 6 and the bucket cylinder 11 are operated in a cooperative manner to thereby swing the bucket 8 so that the bucket 8 can dig the earth and sand. The operation is the same as that of conventional excavators.

Figure 16:
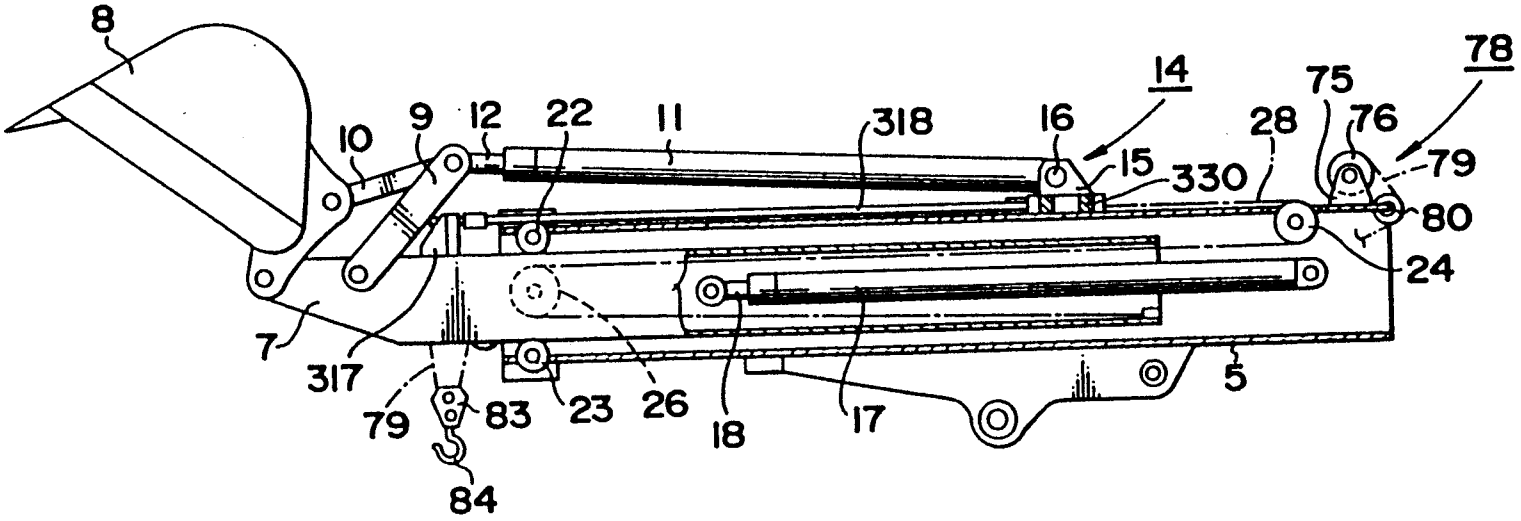
FIG. 16 is a side view, partially in cross section, of assistance in explaining the contracted state of an inner arm where the inner arm is drawn into an outer arm, the inner arm and the outer arm being constituents of the excavator of FIG. 11.
Figure 17:
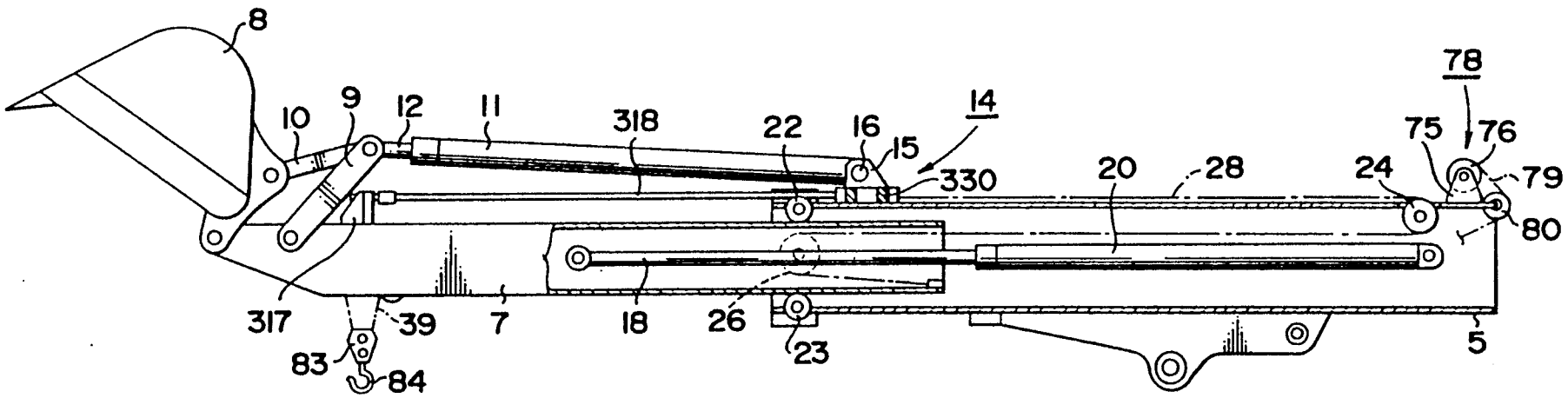
FIG. 17 is a view like FIG. 16, of assistance in explaining the state where the inner arm is stretched the maximum extent from the outer arm.

When the trench or the holes are to be deepened, the bucket 8 is controlled to be moved to the deeper position. At this time, the third hydraulic cylinder 17 receives the oil under pressure and pushes the cylinder rod 18 forwardly. The cylinder rod 18 is moved away from the third hydraulic cylinder 17 for thereby pushing the inner arm 7 out of the outer arm 5, hence the inner arm 7 is slid from the position as illustrated in FIG. 16. Accordingly, the bucket 8 is moved to the position which is located far from the base portion of the outer arm 5 so that the bucket 8 will reach the deepest position (FIG. 17) and dig the earth and sand therein.

At this time, when the inner arm 7 is moved away from the outer arm 5, the interlocking bar 318 fixed to the tip end of the inner arm 7 pulls the slider 14 to thereby move the slider 14 on the upper surface of the outer arm 5 in the longitudinal direction thereof. With the movement of the slider 14, the guides 331, 332 fixed to both sides of the body 330 contact and are guided by both sides of the outer arm 5, hence the slider 14 is not moved off the upper surface of the outer arm 5. Inasmuch as the interlocking bar 318 is not lengthened, the slider 14 moves in synchronism with the movement of the inner arm 7 for the same amount of movement as that of the inner arm 7. When the third hydraulic cylinder 17 is operated to push the inner arm 7 out of the outer arm 5 due to extension of the cylinder rod 18, the bucket 8 is maintained at the same angular relationship relative to the inner arm 7 because the bucket cylinder 11 is moved simultaneously with the extension of the cylinder rod 18 whereby the excavating operation can be made without difficulty.

When the earth and sand dug by the bucket 8 is raised, the third hydraulic cylinder 17 is first operated to retract the cylinder rod 18. The inner arm 7 is moved into the inner portion of the outer arm 5. Inasmuch as the chains 28, 29 are connected to the rear portion of the inner arm 7, the chains 28, 29 are stretched in the direction of the base of the outer arm 5 and are inverted by the sprocket wheels 26, 27 and are further inverted by the sprocket wheels 24, 25 and are moved for thereby moving the slider 14 in the direction of the base of the outer arm 5.

Accordingly, when the inner arm 7 is moved in the same manner set forth above, the bucket cylinder 11 is synchronized with the inner arm 7 and undergoes the same amount of movement whereby the bucket 8 is moved while the angular relationship between the bucket 8 and the inner arm 7 is kept the same. Hence, the earth and sand so dug is not dropped from the bucket 8. Thereafter, the first and the second hydraulic cylinders 4, 6 and the bucket cylinder 11 are cooperated with each other so that the earth and sand dug by the bucket 8 is loaded on a truck which is standing by at the rear side of the movable body 1 or is moved and shifted to another portion.

(Hanging operation of the hook body)

A burying and lifting operation of the excavator while the hook 84 supports a heavy object will be described hereinafter.

The hydraulic motor 77 is driven to rotate the drum 76, thereby gradually unwinding the cable 79 that is wound around the drum 76. Accordingly, the cable 79 is pulled out from the tip end of the inner arm 7 so that the hook body 83 is lowered from the inner arm 7. At this time, the cable 79 is successively moved while contacting the outer peripheries of the pulleys 80 and 82.

If the hook 84 is lowered at the appropriate height (assuming that the angular relationship between the outer arm 5 and the boom 3 does not change), the hook 84 is forced to approach the heavy object to be hung so that the hook 84 can suspend the heavy object at the slinging work. Thereafter, the hydraulic motor 77 is driven in the opposite direction to rotate the drum 76 in the opposite direction, thereby rewinding the cable 79. Consequently, the cable 79 is successively pulled in the inner arm so that the hook body 83 is raised together with the heavy object.

(Telescopic operation while the hook body is hung)

There is a situation in which the position of the heavy object must be changed while the heavy object is suspended by the hook 84 in the slinging work. It is not difficult to change the position of the heavy object by changing the angular relationship between the boom 3 and the outer arm 5 in the forward or the rearward direction. Moreover, it is possible to change the position of the heavy object by telescopically moving the inner arm 7 relative to the outer arm 5.

First, if the hydraulic cylinder 17 is operated while the heavy object is suspended by the hook 84, the cylinder rod 18 is extended, thereby pulling the inner arm 7 out of the outer arm 5. That is, the state in FIG. 18 is changed to the state in FIG. 19.

Figure 18:
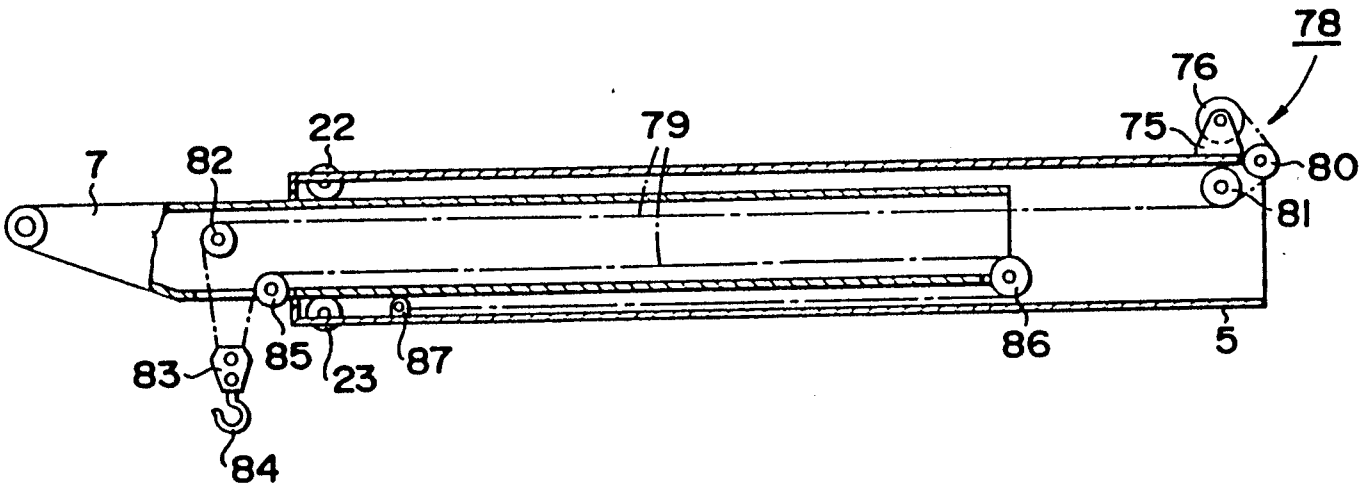
FIG. 18 is a side view, partially in cross section, showing the state where the hook is hoisted while the inner arm is pulled in the outer arm.
Figure 19:
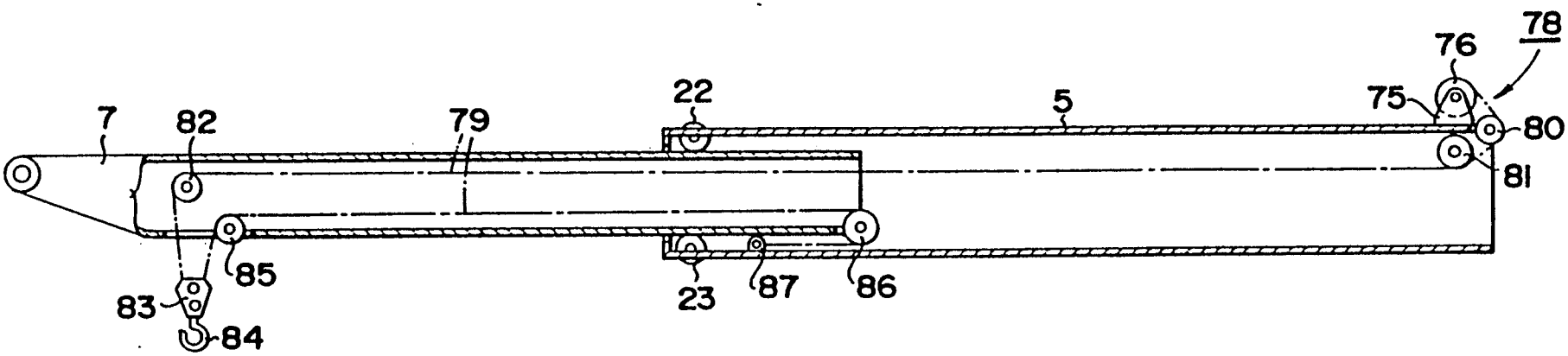
FIG. 19 is a side view, partially in cross section, view showing a state where the hook is hoisted while the inner arm is pulled out from the outer arm.

In the state as illustrated in FIG. 18, the hook body 83 is hung by the wire 79 an end of which is wound around the drum 76 and the other end of which is held by the wire holder 87. If the inner arm 7 is extended at this state, the cable 79 contacting the pulley 82 is kept stopped at its position since the drum 76 is stopped so that the cable 79 is relatively moved upward from the hook body 83. As a result, a part of the wire 79 is drawn from the tip end of the inner arm 7 into the inner arm 7.

However, inasmuch as the pulley 86 is moved in synchronization with the extension of the inner arm 7 and the spacing between the wire holder 87 and the pulley 86 is shorted, the shortened cable 79 permits the pulleys 86, 85 to rotate and pull toward the hook body 83. The cable 79 can be pulled by the weight of the hook body 83 and the weight of the heavy object.

The speed in hoisting the hook body 83 by the pulley 82 becomes the same as the speed in supplying the surplus cable 79 so that the distance between the lower surface of the inner arm 7 and the hook body 83 is always kept constant. Accordingly, it is necessary for the operator to adjust the looseness of the cable 79 since the vertical position of the hook body 83 is not changed even if the state where the inner arm is pulled into the outer arm is changed to be the state where the inner arm 7 is extended from the outer arm 5.

Since the cable attached to the tip end of the inner arm is always pulled out at the same length from the tip end of the inner arm irrespective of the telescopic operation between the inner arm and the outer arm, it is not necessary to manually adjust the length of the wire which is loosened in synchronization with the telescopic operation.

Furthermore, since the hoist mechanism can be disposed at the rear portion of the outer arm, the moment load can be reduced, thereby improving the hanging capacity.

The entire contents of U.S. Ser. No. 07/506,690, filed Apr. 9, 1990, are incorporated herein by reference.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An excavator comprising:

a movable body;

a boom pivotally mounted at a rear end thereof on a front portion of the movable body;

first hydraulic cylinder means mounted at a rear end thereof on the first portion of the movable body, the first hydraulic cylinder means being provided with cylinder rod means connected at a front end thereof with substantially the central portion of the boom for swinging the boom vertically in a longitudinal direction thereof;

an outer arm pivotally swingably mounted on a front end of the boom, said outer arm having a rear end and a front end which extends forwardly from the boom;

a second hydraulic cylinder mounted on a rear surface of the boom, the second hydraulic cylinder being provided with a piston rod connected to a rear portion of the outer arm for changing the angular relationship between the boom and the outer arm;

an inner arm inserted into the outer arm and movable telescopically relative to the outer arm in the longitudinal direction of the outer arm, said inner arm having a rear end located inside the outer arm and a front end extending forwardly from the outer arm;

a bucket pivotally connected to the front end of the inner arm;

a bucket cylinder provided with a piston rod and having a front end operatively connected to the bucket;

guide means fixed to the outer arm;

a guide mechanism slidably mounted on the guide means, said guide mechanism having a front end and a rear end, said guide mechanism being connected to a rear end of the bucket cylinder for sliding the bucket cylinder to thereby move the bucket cylinder and its piston rod as a unit in synchronism with the movement of the inner arm so that the angular relationship between the bucket and the inner arm is kept unchanged;

a third hydraulic cylinder connected to the rear end of the outer arm and having a rod connected to a central portion of the inner arm for moving the inner arm telescopically relative to the outer arm;

synchronous means for moving the bucket cylinder relative to the outer arm for a distance corresponding to the distance the inner arm moves relative to the outer arm, said synchronous means comprising first sprocket wheel means supported at the rear end of the outer arm, and chain means connected at one end thereof to said guide mechanism and connected at the other end thereof to the rear end of the inner arm, said chain means extending from said guide mechanism into engagement with said first sprocket wheel means so as to be inverted thereby, from said first sprocket wheel means through a space between the inner arm and the outer arm into engagement with said second sprocket wheel means so as to be further inverted thereby and then from said second sprocket wheel means to the rear end of the inner arm; and interlocking means connected between the guide mechanism and the front portion of the inner arm to maintain a constant spacing therebetween.

2. An excavator as claimed in claim 1 wherein said first sprocket wheel means comprises a pair of laterally spaced-apart first sprockets disposed adjacent to opposite lateral sides of the outer arm, said second sprocket wheel means comprises a pair of laterally spaced-apart second sprockets disposed adjacent to the opposite lateral sides of said outer arm and said chain means comprises a pair of chains which are each drivingly engaged with one of said first sprockets and one of said second sprockets.

3. An excavator as claimed in claim 1 including two pairs of rollers having small diameters and mounted on upper and lower surfaces, respectively, of said outer arm close to the front end thereof and adjacent to opposite lateral sides of said outer arm, said rollers supporting said inner arm for lengthwise movement with respect to said outer arm.

4. An excavator as claimed in claim 1 in which said outer arm has an upper wall having opposite lateral edges thereof protruding laterally beyond sides of said outer arm and defining said guide means, said guide mechanism comprising a slider having guide bodies for receiving the protruding lateral edges of the upper wall of the outer arm so that the slider is held in sliding engagement with the guide bodies, antifriction slides affixed to the slider and slidably engaging the upper surface of the upper wall of the outer arm, and a pair of supporting plates disposed parallel to each other and projecting upwardly from the slider and adapted to pivotally support the rear end of the bucket cylinder.

5. An excavator as claimed in claim 4 in which said guide bodies have inwardly opening, substantially C-shaped portions on the inner sides thereof, an L-shaped antifriction sliding member disposed in each of said C-shaped portions so that a slot is provided for receiving the adjacent protruding lateral edge of the upper wall of the outer arm, said slider having a centrally located, horizontal through-hole extending through the slider in the longitudinal direction of the outer arm, and a pair of joint holes disposed on opposite lateral sides of and extending parallel with said through-hole.

6. An excavator according to claim 5, wherein the interlocking means comprises an interlocking bar made of a thin metal band having high rigidity, fixing screws fixed to front end and rear end of the interlocking bar, the rear fixing screw being inserted into the thorough-hole and secured to said slider, a fixing member secured to the front end of the inner arm, the front fixing screw being fixedly secured to the fixing member whereby the spacing between the fixing member and the slider is adjusted by the fixing screws.

7. An excavator according to claim 6, wherein the chain means have screw means connected thereto, said screw means being received in said joint holes and being secured therein.

8. An excavator as claimed in claim 6, further comprising a hook mechanism located at the front end of the inner arm, a hoist fixed to the rear end of the outer arm, a first pulley mounted close to the rear end of the outer arm, a second pulley mounted inside the inner arm at the front end thereof, a third pulley supported at the front end of the inner arm, a fourth pulley supported at the rear end of the inner arm, a hook body having a hook attached to the lower portion thereof, and a cable which extends from the hoist, is reversed by the first pulley and then is guided through the inner central portion of the inner arm, is then directed downwardly by the second pulley, the hook body being connected to the cable between the second and third pulley, the cable being guided by the third pulley through the inner arm to the rear end thereof, then being reversed by the fourth pulley and extending forwardly in the space between the inner and outer arms, the front end of the cable being secured to the outer arm adjacent to the forward end thereof.

9. An excavator as claimed in claim 1 including lifting hook means disposed on said inner arm for lifting a load.

* * * * *

UNITED STATES PATENT AND TRADEMARK OFFICE

CERTIFICATE OF CORRECTION

PATENT NO. : 5 267 824

DATED : December 7, 1993

INVENTOR(S) : Mitsuhiro Kishi

It is certified that error appears in the above-identified patent and that said Letters Patent is hereby corrected as shown below:

On the title page, Section [73] Assignee:
after "Kabushiki Kaisha Japanic" insert
---d/b/a Japanic Corporation---.

Column 14, line 21; change "first portion" to
---front portion---.
line 67; after "arm," insert ---second sprocket wheel means supported at the front end of the outer arm,---.
Column 15, line 39; change "the upper" to ---an upper---.
line 43; change "the rear" to ---a rear---.
line 46; delete "the".
Column 16, lines 13 and 14; change "thorough-hole" to
---through-hole---.

Signed and Sealed this
Seventeenth Day of May, 1994

Bruce Lehman

*Attest:*

BRUCE LEHMAN

*Attesting Officer*

*Commissioner of Patents and Trademarks*